United States Patent [19]

Harding et al.

[11] 4,382,592

[45] May 10, 1983

[54] APPARATUS FOR COLLATING SHEETS INTO SETS AND FINISHING THEREOF

[75] Inventors: Steven R. Harding, Idaho Falls, Id.; Richard A. Lamos, Delray Beach, Fla.; Donald C. Roller, Boulder, Colo.

[73] Assignee: International Business Machines Corporation, Armonk, N.Y.

[21] Appl. No.: 290,468

[22] Filed: Feb. 2, 1981

Related U.S. Application Data

[63] Continuation of Ser. No. 77,958, Sep. 24, 1979, abandoned.

[51] Int. Cl.[3] ..... B42B 2/00; B65H 39/00

[52] U.S. Cl. ..... 270/53; 227/41; 227/99; 227/105; 270/58; 271/207; 414/54

[58] Field of Search ..... 270/53-58, 270/95; 271/207, 212, 217; 414/54; 227/41, 99, 105

[56] References Cited

U.S. PATENT DOCUMENTS

| | | | |
|---|---|---|---|
| 3,205,739 | 9/1965 | Meyer-Jagenberg | 270/95 |
| 3,735,978 | 5/1973 | Turner . | |
| 3,744,790 | 7/1973 | Hoffman . | |
| 3,774,902 | 11/1973 | Schulze . | |
| 3,774,906 | 11/1973 | Fagan . | |
| 3,964,741 | 6/1976 | Kroeker . | |
| 4,072,304 | 2/1978 | Brown . | |
| 4,083,550 | 4/1978 | Pal . | |
| 4,203,587 | 5/1980 | Kishi . | |
| 4,318,539 | 3/1982 | Lamos | 270/58 |

FOREIGN PATENT DOCUMENTS

| | | |
|---|---|---|
| 1269006 | 3/1972 | United Kingdom . |
| 1522068 | 8/1978 | United Kingdom . |
| 1542670 | 3/1979 | United Kingdom . |

OTHER PUBLICATIONS

German Specification DOS 1905416, Feb. 4, 1969, "Sorting Store for Duplicating Systems".

*Primary Examiner*—A. J. Heinz

*Attorney, Agent, or Firm*—Carl M. Wright; J. G. Cockburn

[57] ABSTRACT

An improved offset collator comprising a sheet gripper-/injector transport station and an oscillating sheet receiving station. Copy sheets are transported to the sheet gripper/injector transport station in a specified sequence whereupon they are gripped by the transport station, and in a reciprocating motion, transported to the oscillating sheet receiving station where they are injected into a stack of sheets and released. The oscillating sheet receiving station is synchronized with transport station such that the copy sheets are inserted in the oscillating sheet receiving station in an alternate offset posture. A cooperating logic control system causes the sheets to be inserted into the oscillating sheet receiving station in the proper order and offset. After offset collation is completed, the offset stapling station then cooperates with the oscillating sheet receiving station to staple sets of sheets still in their offset posture.

16 Claims, 13 Drawing Figures

(OFFSET COLLATION MODE)

(OFFSET STAPLING MODE)

APPARATUS FOR COLLATING SHEETS INTO SETS AND FINISHING THEREOF

This is a continuation of application Ser. No. 077,958, filed Sept. 24, 1979, now abandoned.

CROSS-REFERENCE TO RELATED APPLICATION

Application Ser. No. 205,061, now U.S. Pat. No. 4,318,539, filed Nov. 7, 1980, a continuation of Application Ser. No. 4,773, filed Jan. 19, 1979, (now abandoned) a Continuation In Part of application Serial No. 856,551 filed Dec. 1, 1977, (now abandoned) all entitled "Apparatus for and Method of Collating, Sorting and Stacking Sheets Concurrently" by Richard A. Lamos and assigned to the same assignee as this application, contains related subject matter.

BACKGROUND OF THE INVENTION (1) Field of the Invention

This invention relates generally to an improved offset collator. More specifically, this invention relates to a unique set finisher which incorporates the improved offset collator with an offset stapler.

(2) Description of the Prior Art

An important, but more general application of the offset collation method is disclosed in the previously cited related U.S. Application to Lamos. Lamos defines the terms "collate," "sort" and the difference between these terms, which are old in the prior art, and the new term "offset collate," which is defined for the first time in the related application.

Lamos recognized that the size of conventional collators is directly dependent on the number of discrete bins and the physical dimensions of the bins. Generally, the number of discrete bins determines the maximum number of sets that can be collated in a particular job. Consequently, the physical dimensions of the discrete bins, characterized by their height, width and depth determine the maximum sheet size that can be processed and the maximum number of sheets per discrete bin.

Lamos also recognized that since there is an overall physical size limitation, the solution in the prior art machines has been to strike a balance between the maximum number of sets that can be collated in a job and the maximum number of sheets that can comprise a set. Thus, in order to meet the physical size requirements, typical prior art machines have a capacity of about 20 sets comprising 100 sheets each, giving a total sheet capacity of 2,000.

The solution to the physical size problem, as disclosed in the cited related application, was the invention of offset collator and method for accomplishing same. The solution was to invent a unibin collator and develop the method of offset collation so that sheets to be offset collated would be alternately offset from each other in an arcuate transport path and then inserted, in the proper order, into a unibin receiving station. Consequently, this apparatus eliminated the need for discrete bins. Due to the use of a single bin, the offset collation method and an arcuate transport path, the apparatus was smaller in physical size than typical prior art collators, but yet had the same total sheet capacity thereof.

Nevertheless, although the Lamos apparatus made many improvements over the prior art, there is still a need for an improved offset collator that is still small in the prior art sense and provides an offset collator that is simpler in operation, more reliable and simpler in construction.

Additionally, in the previously cited related U.S. application to Lamos, it was recognized that there are other job requirements that cannot be satisfied by a collator having a plurality of discrete bins. The example given was for a collator having a maximum set capacity of 20 and a maximum sheet capacity of 100 sheets per set still giving a total sheet capacity of 2,000. Although it has been found in practice that seldom will there be the concurrent job requirement of more than 20 sets and more than 100 sheets per set, there are situations where the job will require the number of sets to be more than 20 and the number of sheets to be more than 100 sheets per set. It is clear from this example that the specified collator cannot process these jobs in the conventional sense.

Thus, as suggested in the referenced application to Lamos, there is a need to eliminate limitations in job flexibility characterized by the number of discrete bins and the sheet capacity of each bin. Consequently, it was recognized that there is a need for collators having substantially infinite job flexibility limited only by the total number of sheets in a job rather than the total number of sets in a job or the total number of sheets in a set.

There is an additional need in job flexibility in the case where offset collation is not required but sortation is required. Collating is defined herein as the insertion of a copy of an original in each of a plurality of sets. Sorting is defined herein as the directing of a sheet or sheets to a given place or rank according to kind or class, e.g., by stacking jobs so as to be demarcated from each other. Consequently, there is a need for an apparatus that not only can perform the offset collation method more reliably, but can also, in the same apparatus, perform a sortation operation without loss of speed, reliability or convenience.

Finally, there is an additional need in the prior art, as applied to offset collators, which has not been addressed by either Lamos in the referenced application, or as far as is known, anywhere else in the prior art. This additional need is offset stapling. It is defined herein as the stapling of offset collated sets or offset sorted jobs such that the offset collated sets or offset sorted jobs are maintained in their proper order and proper offset posture before, during and after the offset stapling process.

Consequently, there is not only a need in the prior art for an improved offset collator that can also operate in an offset sorting mode, but an additional need for an offset stapling station cooperating with the improved offset collator to staple the finished offset collated sets or offset sorted jobs, thereby providing completed finished sets or jobs.

OBJECTS OF THE INVENTION

Accordingly, an important object of the present invention is to offset collate in an improved manner delivering sheets of sets to be offset collated to a receiving station without prior angular or offset displacement.

Another important object of the present invention is to further reduce the physical size of collators without compromising the total sheet handling capacity thereof.

Yet another important object of the present invention is to incorporate the capability of offset sorting in the improved offset collator.

Still another important object of the present invention is to configure the improved offset collator such that an offset stapler can be used therewith in the offset collating mode or the offset sorting mode such that a stapling function can proceed while maintaining the offset posture of the offset collated set or offset sorted jobs.

A further object of the present invention is to incorporate all of the foregoing devices and functions to provide an improved set finisher.

SUMMARY OF THE INVENTION

The apparatus, according to the invention, by which these and other objects, features and advantages are accomplished is characterized inter alia, by providing an improved apparatus for and method of set finishing by using the method of offset collation, offset sorting and/or subsequent offset stapling of the concurrently collated, sorted and stacked sets or offset sorted jobs.

When the apparatus is operated as an offset collator, the first sheets of sets to be offset collated, numbering up to the desired number of sets in a job, are transported via a sheet gripper/injector transport station having a reciprocating feed path to and from an oscillating sheet receiving station. These first sheets are injected in the oscillating sheet receiving station, in response to its oscillatory motion, in an alternate offset posture clearly demarcating the sets to be offset collated. The second sheets of the aforementioned sets are then sequentially inserted contiguous to the first sheets of their sets. This process is repeated until all the sheets comprising a set have been inserted into all the sets comprising the job. In the offset collation mode, the aforementioned transport station and its reciprocating motion is synchronized with the aforementioned receiving station and its oscillatory motion such that each sheet that is injected into the receiving station is given an alternate offset posture.

When the apparatus is operated as an offset sorter, the sheet gripper/injector transport station coacts with the oscillating sheet receiving station such that the oscillatory motion of the receiving station is not in synchronization with the reciprocating motion of the transport station during the insertion of each sheet. They are in synchronization before and after the insertion of each job to be sorted. Thus, the sheets of a job are stacked in the receiving station, when it is in one offset posture, one upon the other. Then the second job to be sorted is stacked on top of the first job when the receiving station oscillates to an opposite offset posture. This process is continued until all of the jobs to be sorted have been stacked in the receiving station.

In either of the foregoing situations, if stapling is desired to provide completely finished sets or jobs, an offset stapling station cooperates with the oscillating sheet receiving station such that a corner(s) of the offset collated sets or sorted jobs therein is elevated and supported by the offset stapling station. The first set or job is then corner-stapled whereupon a subsequent oscillation of the oscillating sheet receiving station causes the corner of this first set or job to fall back into the oscillating sheet receiving station. This oscillatory motion also causes the second set or job to be positioned properly in the offset stapling station for subsequent stapling. After stapling of this second set or job, the process is repeated until all the sets or jobs have been corner-stapled. The offset stapling method maintains the sets or jobs in their alternate offset posture before, during and after stapling.

BRIEF DESCRIPTION OF THE DRAWINGS

The foregoing and other objects, novel features and advantages of the present invention will be apparent from the following more particular description of the preferred embodiments as illustrated in the accompanying drawings, in which.

DESCRIPTION OF THE PREFERRED EMBODIMENTS

The following is a description, according to the invention, of the improved apparatus for and method of offset collating and offset sorting. The present invention also includes a device for offset stapling the collated sets or sorted jobs. The operation of the apparatus, according to the invention, is described and explained hereinafter under the heading "Statement of the Operation."

Figure 1:
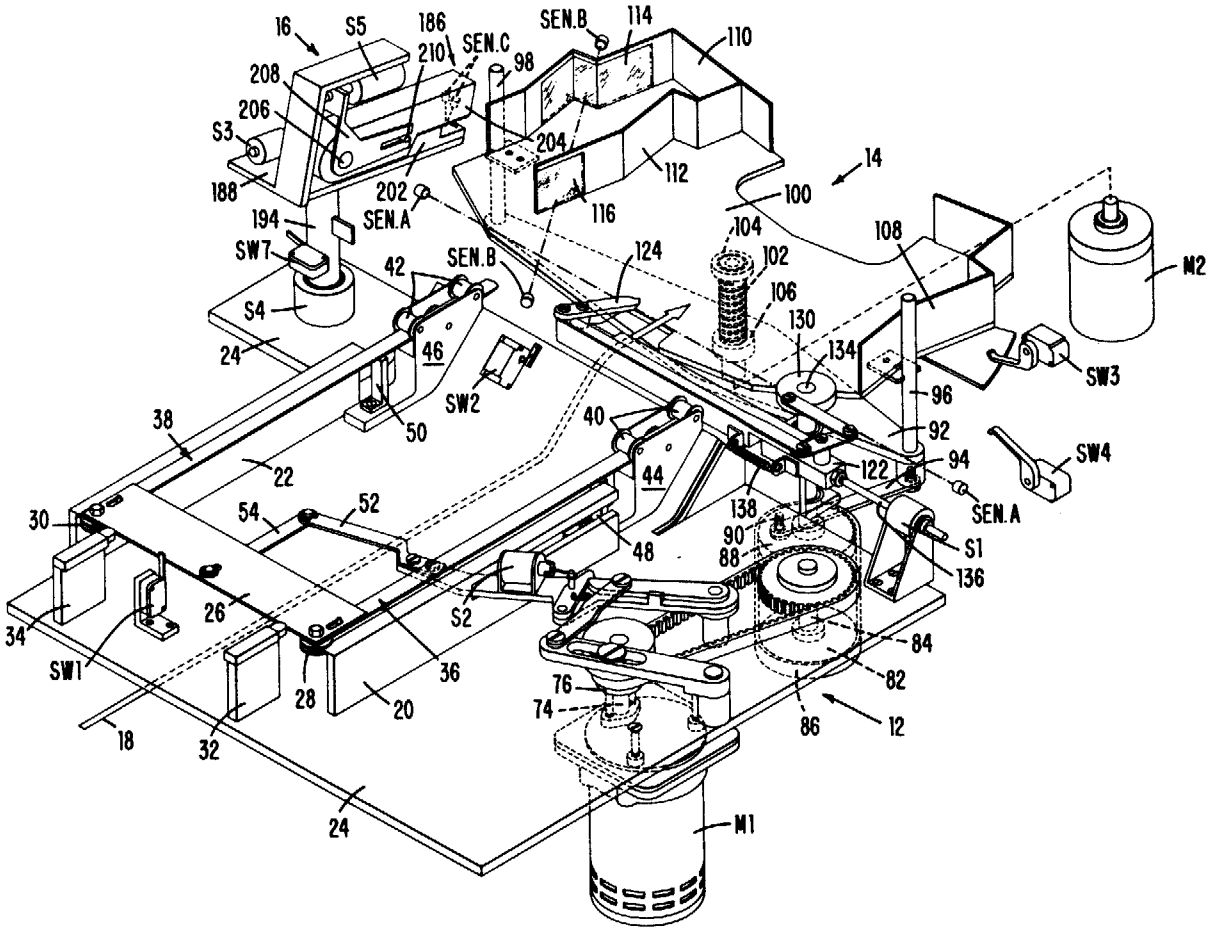
FIG. 1 is a perspective view of the apparatus, according to the invention, showing, inter alia, the principal elements of the sheet gripper/injector transport station, the oscillating sheet receiving station and the offset stapling station.

Referring then to FIG. 1, the offset finisher 10 comprises generally a sheet gripper/injector transport station 12, an oscillating sheet receiving station 14 and an offset stapling station 16. The sheets to be offset collated are fed sequentially, i.e., all of pages one up to the number of sets to be offset collated, then all of pages two and so on, by a sheet feeder associated with an electrophotographic copier or like machine (not shown) along a sheet path 18 to sheet gripper/injector transport station 12.

If the sheets are to be offset sorted, they are fed according to job order rather then sequentially, i.e., all of the pages of the first job, then all of the pages of the second job and so on. Accordingly, the apparatus, depending on how the sheets are fed thereto, can be operated as an offset collator or an offset sorter clearly demarcating collated sets or sorted jobs and readying them for the subsequent offset stapling operation.

Still referring to FIG. 1, sheet gripper/injector transport station 12 comprises right and left slide support rails 20 and 22 affixed to a main support plate 24. A gripper/injector carrier 26 is slidably attached to the aforementioned slide support rails via a right rail bearing 28 and a left rail bearing 30. A right rear carrier stop 32 and a similar left rear carrier stop 34 are also fixedly attached to main support plate 24 and cooperate with gripper/injector carrier 26 in an important aspect of the operation of sheet gripper/injector transport station 12, to be discussed hereinafter.

Additionally, a right gripper/injector device 36 and a similar left gripper/injector device 38 are operatively attached to gripper/injector carrier 26, aforementioned. Gripper/injector devices 36 and 38 are slidably affixed to right gripper/injector device bearings 40 and left gripper/injector device bearings 42, respectively. Gripper/injector device bearings 40 and 42 are respectively rotatably connected to a right gripper/injector bearing mount 44 and a left gripper/injector bearing mount 46. The aforementioned bearing mounts are fixedly attached to main support plate 24. Fixedly attached to right gripper/injector bearing mount 44 and left gripper/injector bearing mount 46 are right and left front carrier stops 48 and 50, respectively. These stops also cooperate with gripper/injector carrier 26 in an important aspect of the operation of sheet gripper/injector transport station 12, to be discussed hereinafter.

Figure 5:
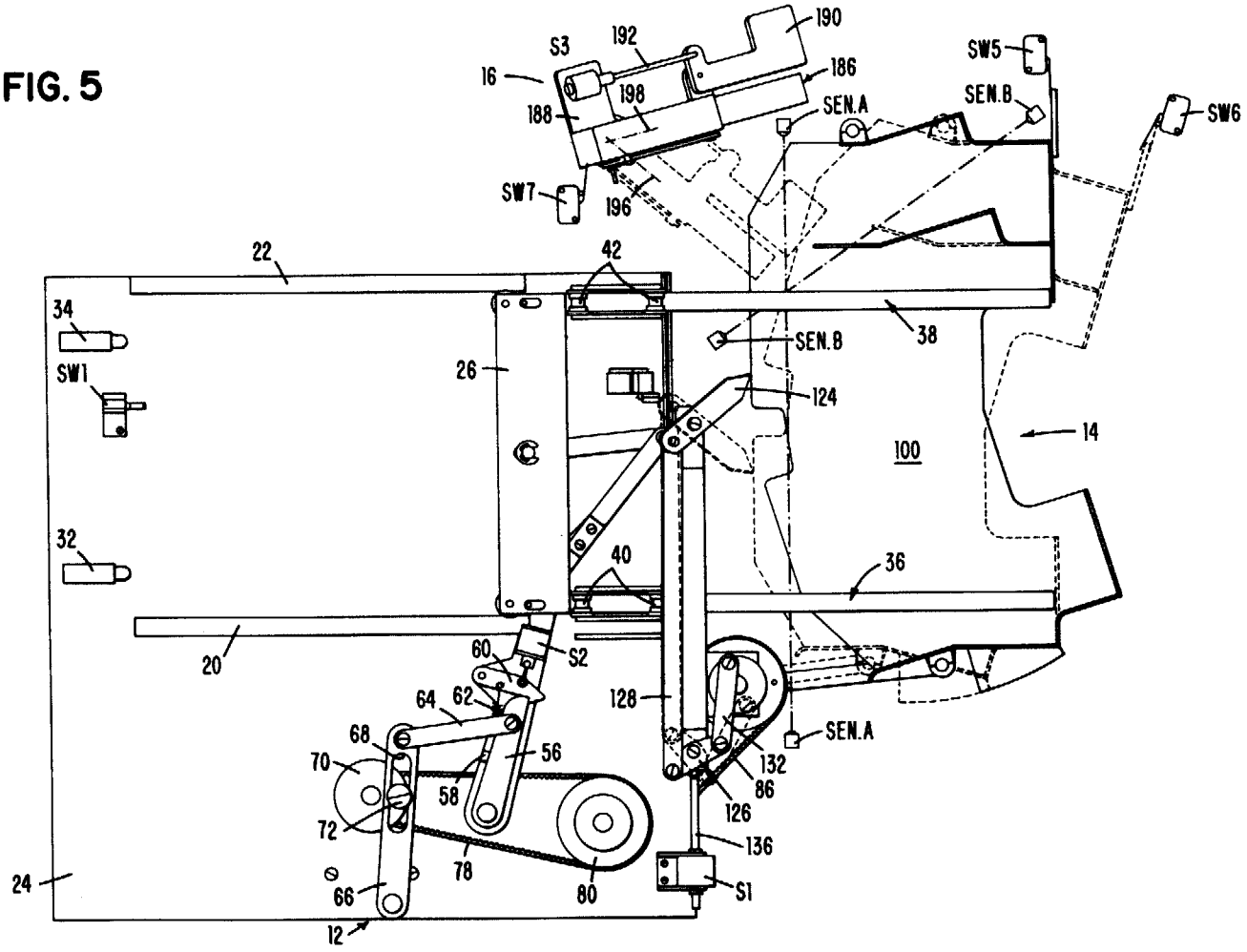
FIG. 5 is a plan view of the apparatus, according to the invention, showing, in particular, certain operational aspects of the sheet gripper/injector transport station, the oscillating sheet receiving station and the offset stapling station.

As shown in FIGS. 1 and 5, one end of a gripper/injector carrier drive arm 52 is pivotally connected to main support plate 24 and the other end thereof is operatively connected to gripper/injector carrier 26 via gripper/injector carrier drive arm link 54. A gripper/injector carrier drive arm interposer 56 is pivotally connected to the same point on main support plate 24 as gripper/injector carrier drive arm 52 and contiguous thereto. In normal operation, gripper/injector carrier drive arm interposer 56 is latched against gripper/injector carrier drive arm stop 58 by gripper/injector carrier drive arm latch 60 which is pivotally and contiguously connected to gripper/injector carrier drive arm 52. Gripper/injector carrier drive arm latch 60 is biased by latch spring 62 so that gripper/injector carrier drive arm interposer 56 is latched in the situation where sheet gripper/injector transport station 12 is operating in an offset collation or offset sorting mode, to be discussed hereinafter.

An injector disable solenoid S2 is operatively connected to gripper/injector carrier drive arm latch 60 such that it is normally held in a latched position as mentioned above, and held in a nonlatched position, freeing gripper/injector carrier drive arm interposer 56, during the offset stapling mode also to be discussed hereinafter.

An interposer drive link 64 operatively connects one end of an interposer drive arm bell crank 66 to gripper/injector carrier drive arm interposer 56.

The other end of interposer drive arm bell crank 66 is pivotally connected to main support plate 24. A bell crank slot 68 in interposer drive arm bell crank 66 is operatively connected to injector/interposer arm drive cam 70, via drive cam shoulder fastener 72.

According to the apparatus of FIG. 1, an injector motor M1, via injector motor shaft 74 drives injector/interposer arm drive cam 70 and main drive pulley 76. A drive belt 78, operatively attached to main drive pulley 76, couples injector motor M1 to a top intermediate pulley 80. Additionally, top intermediate pulley 80 is operatively connected to a bottom intermediate pulley 82, via intermediate pulley shaft 84. As shown, intermediate pulley shaft 84 is journaled into main support plate 24. An intermediate pulley drive belt 86 couples driving power from bottom intermediate pulley 82 to driven pulley 88. In turn, this driving power, via an eccentrically mounted fastener 90, fixedly attached to driven pulley 88, is coupled to sheet receiving bin drive plate 92 via sheet receiving bin drive link 94.

The oscillating sheet receiving station 14 of FIG. 1 comprises, inter alia, right and left bin vertical guide posts 96 and 98 which are slidably connected to right and left sides, respectively, of oscillating sheet receiving bin 100, and which are fixedly attached to sheet receiving bin drive plate 92 aforementioned. Oscillating sheet receiving bin 100, guided by the aforementioned guide posts, is movable upwardly or downwardly, by sheet receiving bin elevation screw 102. This screw has a bearing surface 104, which coacts with a sheet receiving bin drive plate nut 106 so as to cause oscillating sheet receiving bin 100 to move up or down when sheet receiving bin elevation screw 102 is driven by elevator motor M2. Bearing surface 104 supports oscillating sheet receiving bin 100, at the center of gravity thereof, thus, allowing it to oscillate in a clockwise or counterclockwise direction with stability.

In order that sheets deposited into oscillating sheet receiving bin 100 are properly injected and maintained in an alternate offset posture, it has affixed thereto a right outside contoured frame 108, a left outside contoured frame 110 and an inside contoured frame 112. Inside contoured frame 112 is removably attached to the aforementioned bin. The outside contoured frame 108 and 110 allow oscillating sheet receiving bin 100 to properly alternately offset sheets of $8\frac{1}{2}\times 14$ inches. Right outside contoured frame 108, in coaction with inside contoured frame 112, when inserted into oscillating sheet receiving bin 100, allow it to properly alternately offset sheets of $8\frac{1}{2}\times 11$ inches. In addition, left outside contoured frame 110 and inside contoured frame 112 have inserted therein windows 114 and 116, respectively. The purpose of these windows will be explained under the heading "Statement of the Operation" hereintofollow.

Oscillating sheet receiving station 14 also includes an oscillating sheet separator/supporter device 118. It comprises a fixed mounting bar 120 slidably connected to a slidable mounting bar 122. An oscillating finger 124 is pivotally connected to fixed mounting bar 120 and operatively connected to oscillating bell crank 126 via oscillating finger link 128. This link is operatively connected to finger driven cam 130 by driven cam link 132. A driven cam shaft 134 operatively connects finger driven cam 130 to the aforementioned driven pulley 88. A portion of driven cam shaft 134 is journaled into a portion of main support plate 24.

Due to the coaction of the various elements previously described, injector motor M1 furnishes the power, via the various cams, links and belt couplings, to operate, as so far described, sheet gripper/injector transport station 12 and oscillating sheet receiving station 14. As will be described hereinafter, injector motor M1 also plays a part in the operation of offset stapling station 16.

Figure 2:
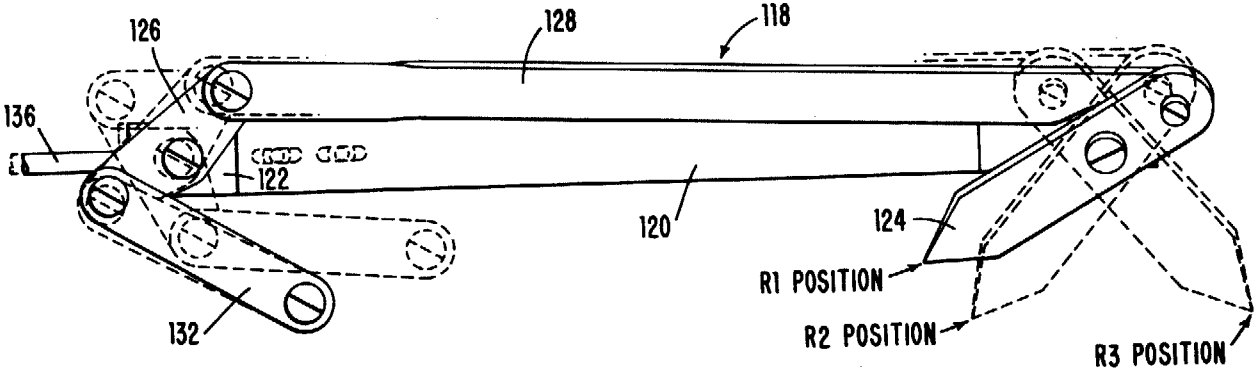
FIG. 2 is a partial plan view of the oscillating sheet separator/supporter device of the oscillating sheet receiving station of FIG. 1.

Referring now to FIGS. 1 and 2 concurrently, a finger home solenoid S1, when deactivated, via finger home solenoid plunger 136, allows slidable mounting bar 122 to slide towards fixed mounting bar 120 by the force of home finger spring 138. Accordingly, oscillating finger 124 is rotated to the home or R1 position. However, when finger home solenoid S1 is activated, it will cause oscillating finger 124 to rotate to either an R2 or R3 position, i.e., an operable position, as shown in FIG. 2, by causing slidable mounting bar 122 to slide away from fixed mounting bar 120 against the force of finger home spring 138. When oscillating finger 124 is in the home or R1 position, oscillating sheet receiving bin 100 can be moved upwardly or downwardly by elevator motor M2. All of the foregoing is discussed more fully under the heading "Statement of the Operation"

Also shown are a plurality of switches, sensors and other solenoids which have various functions performed according to the operation of the invention. For purposes of the description, it suffices to show the placement of some of these devices in relationship to the elements of the apparatus previously described. The operation of these devices will be discussed further in conjunction with the operational modes of the apparatus.

Referring again to FIG. 1, injector home switch SW1 is disposed to sense when gripper/injector carrier 26 is in a home position, and, accordingly, when gripper/injector devices 36 and 38 are in a position to receive sheets fed along sheet path 18. Sheet path switch SW2 is disposed to sense when a sheet has been gripped by the aforementioned gripper/injector devices, and, accordingly, is ready to be injected into oscillating sheet receiving station 14. Bin up limit switch SW3 and bin down limit switch SW4 are disposed to cooperate with oscillating sheet receiving bin 100 to sense the upper and lower limits of the bin to facilitate proper offset collation, offset sorting and offset stapling, according to the invention.

Referring to FIG. 5, bin position A switch SW5 and bin position B switch SW6 determine, respectively, whether the bin is in a counterclockwise or clockwise position. The counterclockwise position is the preferred position for offset collation, offset sorting or offset stapling to commence. Stapler in position switch SW7 (see FIG. 4) is disposed to sense that stapling device 186 is in an operative position so that offset stapling can be commenced.

Still referring to FIG. 1 and again to FIG. 5, bin down sensor SEN. A, which for purposes of the invention can be a light and photocell combination or a light emitting diode/phototransistor combination, is disposed so as to determine that oscillating sheet receiving bin 100, when operating in the offset collation or offset sorting mode, has received approximately 25 sheets or an increment thereof. After 25 sheets or an increment thereof are received, this sensor operates to cause the bin to be lowered so that offset collation or offset sorting can properly continue. This sensor is also used in carrying out an offset collation home procedure to be discussed hereinafter.

Likewise, bin down sensor SEN. B, which for purposes of the invention can be a light and photocell combination or a light emitting diode/phototransistor combination, is disposed so as to determine that the bin, when operating in the offset stapling mode, has deposited therein a stapled set or job. If so, this sensor operates to cause the bin to be lowered so that the next set or job can be properly offset stapled. Other elements of offset stapling station 16 will be described in conjunction with FIGS. 1, 4 and 5 after a discussion of FIGS. 3A and 3B.

Figure 3A:
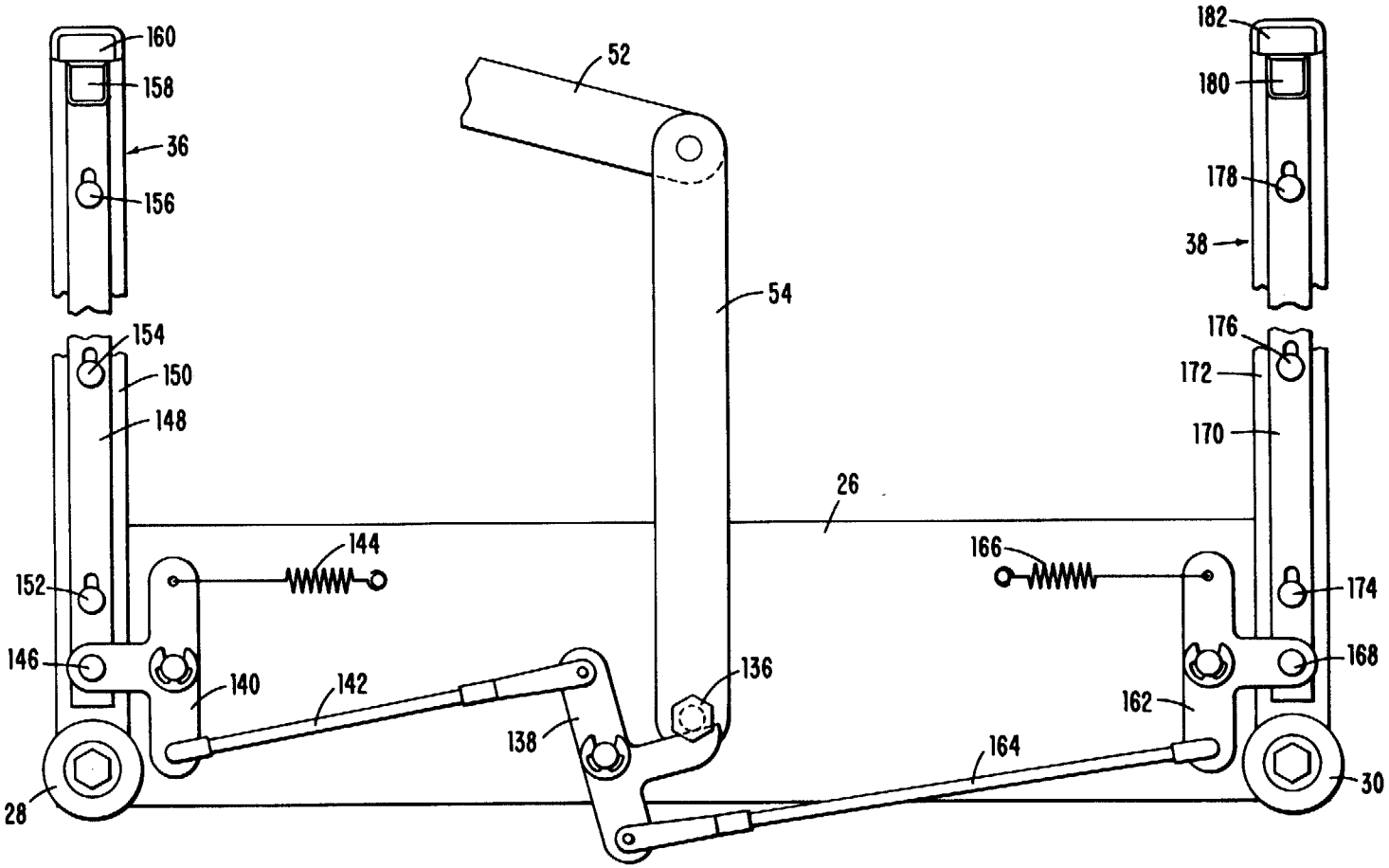
FIG. 3A is a segmented bottom view of the gripper-/injector carrier and gripper/injector devices of the sheet gripper/injector transport station according to the invention.
Figure 3B:
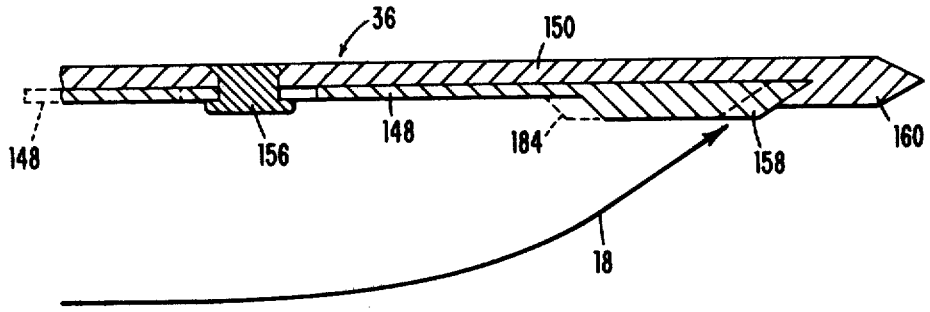
FIG. 3B is a fragmented sectional and elevational view of one of the gripper/injector devices of FIG. 3A.

FIGS. 3A and 3B show elements fixedly and operatively attached to the underside of gripper/injector carrier 26 and the underside of right and left gripper/injector devices 36 and 38, respectively.

Referring first to FIG. 3A, gripper/injector carrier drive arm link 54 is operatively attached to gripper/injector link pin 136. This link pin coacts with center gripper/injector bell crank 138, which is operatively attached to right gripper/injector bell crank 140 via right bell crank pull link 142 operatively connected to one end thereof. Another end of right gripper/injector bell crank 140 is operatively attached to right bell crank bias spring 144. The other end of right gripper/injector bell crank 140 is operatively attached to right gripper/injector actuating pin 146. This pin is fixedly attached to right bottom gripper/injector blade 148, which is slidably attached to right top gripper/injector blade 150, via a plurality of right shoulder rivets 152, 154 and 156. Right bottom gripper/injector blade 148 includes a right bottom gripper/injector jaw 158. Also, right top gripper/injector blade 150 includes a right top gripper/injector jaw 160.

Likewise, center gripper/injector bell crank 138 is also operatively attached to one end of left gripper/injector bell crank 162 via left bell crank pull link 164. Another end of left gripper/injector bell crank 162 is operatively connected to left bell crank bias spring 166. The other end of left gripper/injector bell crank 162 is operatively attached to left gripper/injector actuating pin 168. This pin is fixedly attached to left bottom gripper/injector blade 170. The blade is slidably attached to left top gripper/injector blade 172 via a plurality of left shoulder rivets 174, 176 and 178. Left bottom gripper/injector blade 170 includes a left bottom gripper/injector jaw 180. Also, left top gripper/injector blade 172 includes a left top gripper/injector jaw 182.

FIG. 3B depicts a fragmented sectional and elevational view of right gripper/injector device 36. Illustrated is the opened and closed positions of right bottom gripper/injector jaw 158 as related to right top gripper/injector jaw 160 when a sheet, fed along sheet path 18, is inserted in the aforementioned jaws. This is illustrated by the dotted line depiction represented by numeral 184. Right gripper/injector device 36 is actually shown in the closed position, i.e., the position where a sheet has been gripped. It is preferred that right gripper/injector device 36 and left gripper/injector device 38 (see FIG. 3A) operate in concert on the edge of a copy sheet, as it is fed from an associated copier or like machine (not shown), with its imaged side face down in the case of simplex copies. In the case of duplex copies, the odd numbered pages should be fed face down.

Referring back to FIGS. 1, 4 and 5 concurrently, offset stapling station 16 further comprises, inter alia, a stapler device 186. Stapler device 186 is fixedly attached to a stapler position bracket 188. A first set or job catcher 190 is pivotally attached to stapler device 186. Also, a catcher solenoid S3, via catcher link 192, is operatively connected to first set or job catcher 190. The aforementioned devices operate to ensure that first set catcher 190 is in the proper position to catch the first set or job at the beginning of the offset stapling process.

Figure 4:
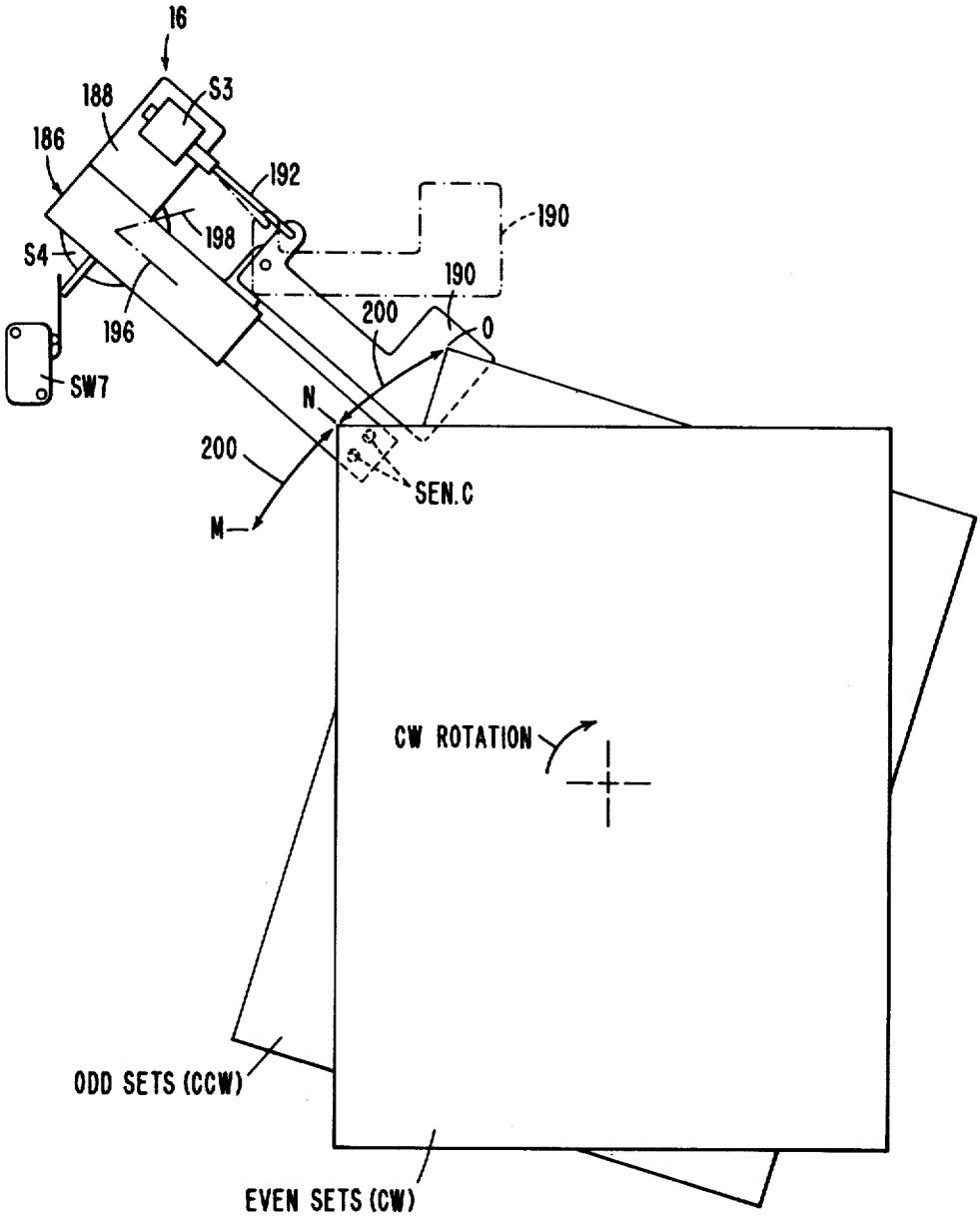
FIG. 4 is a partial plan view of the offset stapling station, according to the invention, operating on offset collated sets or offset sorted jobs.

When offset stapling is commenced and the first set or job has been stapled, first set catcher 190 is pivoted, as shown by the dotted line representation in FIG. 4, into an out position. It is held in this out position during the remainder of the offset stapling process.

A stapler position rotary solenoid S4 is fixedly attached to main support plate 24 and is operatively connected to stapler pivot shaft 194. Stapler pivot shaft 194 is fixedly attached to stapler position bracket 188. Accordingly, when stapler position rotary solenoid S4 is actuated, stapler device 186 is pivoted into an operative position as indicated by the numeral 196 in FIGS. 4 and 5. Contrarily, when stapler position rotary solenoid S4 is deactuated, stapler device 186 is pivoted into an inoperative position as indicated by the numeral 198 in FIGS. 4 and 5. The inoperative position, as shown in FIGS. 1 and 5, is the normal position of stapler device 186 during the offset collation mode or offset sorting mode of operation.

As shown in FIG. 4, numeral 200 indicates the path of travel of odd copy sets or jobs and even copy sets or jobs as they are oscillated through stapler device 186. The travel of the corners of the odd and even sets of jobs are represented by the positions M, N and O. Odd set or job travel, during the offset stapling process, is from O to N and the return path is from N to O. Even set travel is from M to N and the return path is from N to M. Stapling takes place for both odd and even copy sets or jobs at position N.

As shown in FIG. 4 and also FIG. 1, a staple sensor SEN. C is positioned in stapler device 186 such that it senses the corner, at position N, of a set or job to be stapled and, accordingly, causes the corner of the particular set or job to be stapled. Staple sensor SEN. C, for purposes of the invention, can be a light and photocell combination or a light emitting diode/phototransistor combination.

Still referring to FIG. 1, for purposes of the invention, stapler device 186 of offset stapling station 16 can be a modified version of any one of many types of hand-operated desk type staplers. It includes a stapler lower jaw 202 and a stapler upper jaw 204 which form an opening sufficient to staple sets or jobs having thicknesses of approximately 100 sheets. Both of the aforementioned jaws are operatively connected to a stapler pivot pin 206. A stapler bell crank 208 is also operatively connected to stapler pivot pin 206 and a stapler bell crank pin 210 fixedly attached to stapler upper jaw 204. Accordingly, when stapler solenoid S5 is caused to be actuated, inter alia, by the action of staple sensor SEN. C, the set or job in the jaws of stapler device 186 is stapled.

Statement of the Operation

The apparatus, according to the invention, has several modes of operation. These modes of operation may be divided into three groups: the offset collation mode; the offset sorting mode; and the offset stapling mode. The operation of these groups will be discussed in three subsections. The discussion of the logic control system will be discussed in another subsection.

A. The Offset Collation Mode

A general understanding of the offset collation mode can be had by referring to FIGS. 1 and 5 concurrently. The general principles of offset collation have been described earlier under the heading "Background of the Invention" and are discussed in greater detail in the aforementioned U.S. Application to Lamos. Accordingly, the Lamos Application is incorporated herein.

Sheets (not shown) of sets to be offset collated are fed from an associated copier or like machine (not shown), in a sequential relationship via sheet path 18. This sequential relationship is defined as the feeding of all of pages one of the copy sheets of a multipage document up to the number of sets to be offset collated, the feeding of all of pages two, the feeding of all of pages three and so on. With the copy sheets fed in this sequential order, the apparatus, according to the invention, automatically performs the offset collation method.

As shown, stapler device 186 is in an inoperative position when offset collation is taking place. The first sheet of the first set is fed along sheet path 18 and is gripped concurrently by right and left gripper/injector devices 36 and 38. When this sheet makes sheet path switch SW2, injector motor M1 is energized, and via injector motor shaft 74 and associated elements causes right and left gripper/injector devices 36 and 38 to move forward as shown in FIG. 5.

Referring briefly to FIGS. 3A and 3B, initially, before a sheet reaches the jaws of right and left gripper/injector devices 36 and 38, gripper/injector carrier 26 being up against right and left rear carrier stops 32 and 34 (FIG. 1) causes a force, generated primarily by gripper/injector carrier drive arm link 54, to concurrently rotate right and left gripper/injector bell cranks 140 and 142. The foregoing action causes the jaws, aforementioned, to open, as depicted by the dotted line represented by the numeral 184 in FIG. 3B.

Referring back to FIGS. 1 and 5, as soon as a copy sheet enters the jaws and makes sheet path switch SW2, injector motor M1 is energized. This causes right and left gripper/injector devices 36 and 38 to move forward slightly, the aforementioned jaws to close on the copy sheet and right and left gripper/injection devices 36 and 38 to continue to move forward carrying the copy sheet (not shown) into oscillating sheet receiving station 14.

During the insertion of this first copy sheet, oscillating sheet receiving bin 100, of oscillating sheet receiving station 14, is rotated in synchronization with the reciprocating motion of right and left gripper/injector devices 36 and 38, to a counterclockwise position which is sensed by bin position A switch SW5. At the full extent of foward travel of right and left gripper/injector devices 36 and 38, the copy sheet is released by the action of right and left front carrier stops 48 and 50 on right and left gripper/injector actuating pins 146 and 168, respectively (FIG. 3A).

To complete this cycle, injector motor M1 continues to rotate causing a further reciprocating action of gripper/injector carrier 26 and, accordingly, right and left gripper/injector devices 36 and 38. When gripper/injector carrier 26 reaches right and left rear carrier stops 32 and 34, two substantially simultaneous actions take place. First, the jaws of right and left gripper/injector devices 36 and 38 are opened by the action of rear carrier stops 32 and 34 on gripper/injector carrier 26 and right and left gripper/injector actuating pins 146 and 168 (FIG. 3A). Then, injector home switch SW1 is made causing injector motor M1 to turn off completing this cycle. Now oscillating sheet receiving bin 100 is in a position centered between bin position A and B switches SW5 and SW6, respectively, and the aforementioned gripper jaws are opened ready to receive the second copy sheet.

When this second copy sheet, which is page one of the second set, makes sheet path switch SW2, the same process is repeated except that now oscillating sheet receiving bin 100 is rotated in a clockwise direction until bin position B switch SW6 is made. Thus, this second copy sheet is alternately offset from the first copy sheet. The feeding of the first copy sheets is continued until either one of two conditions occur. One condition is that the number of first copy sheets comprising the number of sets number approximately 25. In this situation, bin down sensor SEN. A detects this condition and a partial homing procedure is commenced. Elevator motor M2 is energized so that oscillating sheet receiving bin 100 is lowered in order that right and left gripper/injector devices 36 and 38 can clear the sheets that have already been inserted therein.

The other condition is that the first pages of sets comprising a job have been inserted in oscillating sheet receiving bin 100. In this situation, a complete homing procedure is commenced. Finger home solenoid S1, actuated by a homing signal indicative of the above condition causes ocillating finger 124 to rotate to a home position or the R1 position (FIG. 2). This same homing signal causes elevator motor M2 to rotate raising oscillating sheet receiving bin 100 until bin up limit switch SW3 is made. Then, elevator motor M2 reverses its rotation lowering the bin until bin down sensor SEN. A is made. In the meantime, finger home solenoid S1 has been deactuated causing oscillating finger 124 to rotate back to its position before the start of the complete homing procedure, i.e., either position R2 or R3 as shown in FIG. 2. Accordingly, as the bin is lowered, the copy sheets in the bin are supported by the oscillating finger 124.

When bin down sensor SEN. A is made, the logic control system senses this as a partial homing procedure, which is commenced and carried out as aforementioned. Consequently, the appartus is now ready to accept the second page of the first set. What happens is that as oscillating sheet receiving bin 100 and oscillating finger 124 rotate together in a counterclockwise direction, the first copy sheet of set one is dropped into oscillating sheet receiving bin 100. Since right and left gripper/injector devices 36 and 38 are moving into the bin with the second sheet of the first set, it is inserted on top of the first sheet of the first set contiguous thereto. This second cycle is completed when injector home switch SW1 is made again. Hence, the apparatus is ready for the feeding of the second copy sheet of the second set.

When this second copy sheet makes sheet path switch SW2, injector motor M1 is energized and the process is repeated with gripper/injector devices 36 and 38 moving into oscillating sheet receiving bin 100 which rotates in a clockwise direction until it makes bin position B switch SW6. In the meantime, copy sheet one of the second set is dropped into the bin due to its oscillatory action and the concurrent oscillatory action of oscillating finger 124. Sheet two of set two is then inserted into the bin on top of and contiguous to the first sheet of the second set.

Thus, when the last copy sheet of the last set is inserted into oscillating sheet receiving bin 100, all the sets are separated in an alternate offset posture, and all the sets are properly offset collated.

It should be mentioned that as copy sheets are inserted into oscillating sheet receiving bin 100, the action of bin down sensor SEN. A is to lower the bin in increments of approximately 25 sheets. Accordingly, it is possible for the bin to make bin down limit switch SW4. When this happens there is an indication to the logic control system that the capacity of the bin has been met and no further offset collation can take place. This switch is also used in conjunction with a final homing procedure after offset collation is completed, to raise the bin up into the proper position for offset stapling to be discussed hereinafter.

B. The Offset Sorting Mode

A general understanding of the offset sorting mode can be had by referring again to FIGS. 1 and 5 concurrently. The definition of sorting is explained in the aforementioned U.S. Application to Lamos. Accordingly, the Lamos Application is incorporated herein. To sort is to put in a given place or rank according to kind or class, e.g., by stacking jobs and placing them such that each is demarcated from the other.

In offset sorting, jobs to be sorted are fed in sequence from an associated copier or like machine (not shown) such that the sheets of the job are inserted in oscillating sheet receiving station 14, first, when oscillating sheet receiving bin 100 is in a counterclockwise posture. All of the sheets of the first job are inserted one upon the other in the same offset posture, while the bin is disassociated from the reciprocating action of right and left gripper/injector devices 36 and 38. After all of the sheets of the first job are inserted into oscillating sheet receiving bin 100, While it is in this counterclockwise posture, it is then rotated to a clockwise posture whereupon all of the sheets of the second job are inserted, i.e., stacked one upon the other, clearly demarcating the first job from the second job in an alternate offset posture. In offset sorting, the sheets of a job are placed one upon the other. Hence, oscillating sheet separator/supporter device 118 has no function in this mode of operation.

To sort the third job, oscillating sheet receiving bin 100 is rotated again to a counterclockwise posture whereupon sheets of the third job are inserted in order one upon the other and upon the second job in an alternate offset posture. When all of the sheets of this third job are inserted the bin is again rotated to a counterclockwise posture for the insertion of the fourth job. This process is continued until all of the jobs are inserted into the bin alternately offset from each other.

In this mode of operation, as in the aforementioned offset collation mode of operation, bin down sensor SEN. A detects the condition of approximately 25 sheet increments of sheets stacked in oscillating sheet receiving bin 100. In this situation, a partial homing procedure is commenced. Elevator motor M2 is energized causing oscillating sheet receiving bin 100 to be lowered in order that right and left gripper/injector devices 36 and 38 can clear the sheets that have already been inserted therein.

Referring still to FIGS. 1 and 5 concurrently, several techniques can be used to modify the apparatus to operate in an offset sorting mode. One such technique is to modify the combination of top intermediate pulley 80, bottom intermediate pulley 82 and intermediate pulley shaft 84 to include a well known "single revolution clutch device." The single revolution clutch device would include a latch drive arm fixedly attached to intermediate pulley shaft 84, such that it rotates with the aforementioned shaft. It would also include a clutch latch plate fixedly attached to bottom intermediate pulley 82, a latch drive arm operatively connected to the aforementioned clutch latch plate and pivotally connected, via a pin to the aforementioned latch drive arm. Finally, it would include a solenoid operatively attached to the aforementioned latch drive arm and configured to rotate with the total assembly.

Accordingly, when the solenoid is de-energized, the apparatus of FIG. 1 operates normally as in the offset collation mode, i.e., oscillating sheet receiving bin 100 rotates counterclockwise and then clockwise in synchronization with the insertion of each sheet. However, in the offset sorting mode, the rotation of oscillating sheet receiving bin 100 would be disassociated from the power drive elements of the apparatus by energizing the aforementioned solenoid thereby unlatching the top and bottom intermediate drive pulleys 80 and 82 when the bin is in either a counterclockwise or clockwise posture which corresponds to a first or second job.

Another technique is to modify sheet receiving bin drive link 94 to include an interposer device similar to the one used on gripper/injector carrier drive arm 52. To accomplish this modification, sheet receiving bin drive link 94 would include two links slidably attached via two slots and two shoulder fasteners. One slot, for purposes of discussion the bottom slot, would have a notch therein and be operatively connected to one end of a latch. The other end of this latch would be pivotally connected to the top link. A center portion of the latch would be operatively connected to a solenoid. Thus, when the solenoid is de-energized, both the bottom and top links are latched up and the apparatus would operate as in the offset collation mode. When the apparatus is to be operated in the offset sorting mode, the solenoid is energized and the bottom link is unlatched from the top link and, therefore, the links would move to the maximum travel in their slots. As long as the links are unlatched, oscillating sheet receiving bin 100 would stay in that particular posture. After the insertion of the first job, then the links are latched up, and the bin is rotated in synchronization to, for example, a clockwise posture for the insertion of this second job. After bin reaches this clockwise posture, the solenoid is energized again unlatching the links, thus, keeping the bin in the clockwise posture until insertion of all of the sheets of the second job.

After the completion of the offset sorting process, a complete homing procedure is commenced, as previously mentioned in conjunction with the offset collation mode.

C. The Offset Stapling Mode

The present invention includes means for offset stapling the offset collated or offset sorted sets in oscillating sheet receiving station 14. The general operation of the apparatus in the offset stapling mode can be understood by referring to FIGS. 1, 4 and 6 concurrently.

To commence the offset stapling mode, a staple mode signal is necessary to initiate a stapling home procedure. Finger home solenoid S1 is deactuated which causes oscillating finger 124 to rotate to the R1 position (FIG. 2). Oscillating finger 124 remains in this position throughout the offset stapling sequence. Oscillating sheet receiving bin 100 via elevator motor M2 is raised making bin up limit switch SW3. In the meantime, stapler device 186 is swung into an operative position (FIG. 4). Additionally, first set or job catcher 190 is moved into an in position in order to catch the first (odd) set or job. Then oscillating sheet receiving bin 100 is caused to be lowered whereupon it is stopped by the action of bin down sensor SEN.B. This sensor has the same function in the offset stapling mode as bin down sensor SEN. A, aforementioned, has in the offset collation mode. This sequence of events results in the corner of the stack resting on top of stapler device 186, ready for commencing of the stapling operation.

To commence actual offset stapling of the sets or jobs in oscillating sheet receiving bin 100, injector disable solenoid S2 is energized, disconnecting gripper/injector carrier drive arm 52 from injector motor M1. This causes right and left gripper/injector devices 36 and 38 to remain in the position shown in FIG. 1. However, injector motor M1 is still operatively connected to oscillating sheet receiving station 14.

At the start of the offset stapling mode, oscillating sheet receiving bin 100 always starts rotating from a counterclockwise posture. Accordingly, as shown in FIG. 5, the bin has to make bin position A switch SW5 at the start of the stapling process. Accordingly, as oscillating sheet receiving bin 100 rotates from a counterclockwise position to a clockwise position, the first set or job drops onto first set or job catcher 190. This set then is in the correct vertical alignment with the jaws of stapler device 186 for stapling. A subsequent counterclockwise rotation places the first set or job in a position to be stapled. When a set or job is in the jaws of stapler device 186, staple sensor SEN. C causes stapler device 186 to be actuated at position N (FIG. 4) by staple solenoid S5 being actuated.

Figure 6:
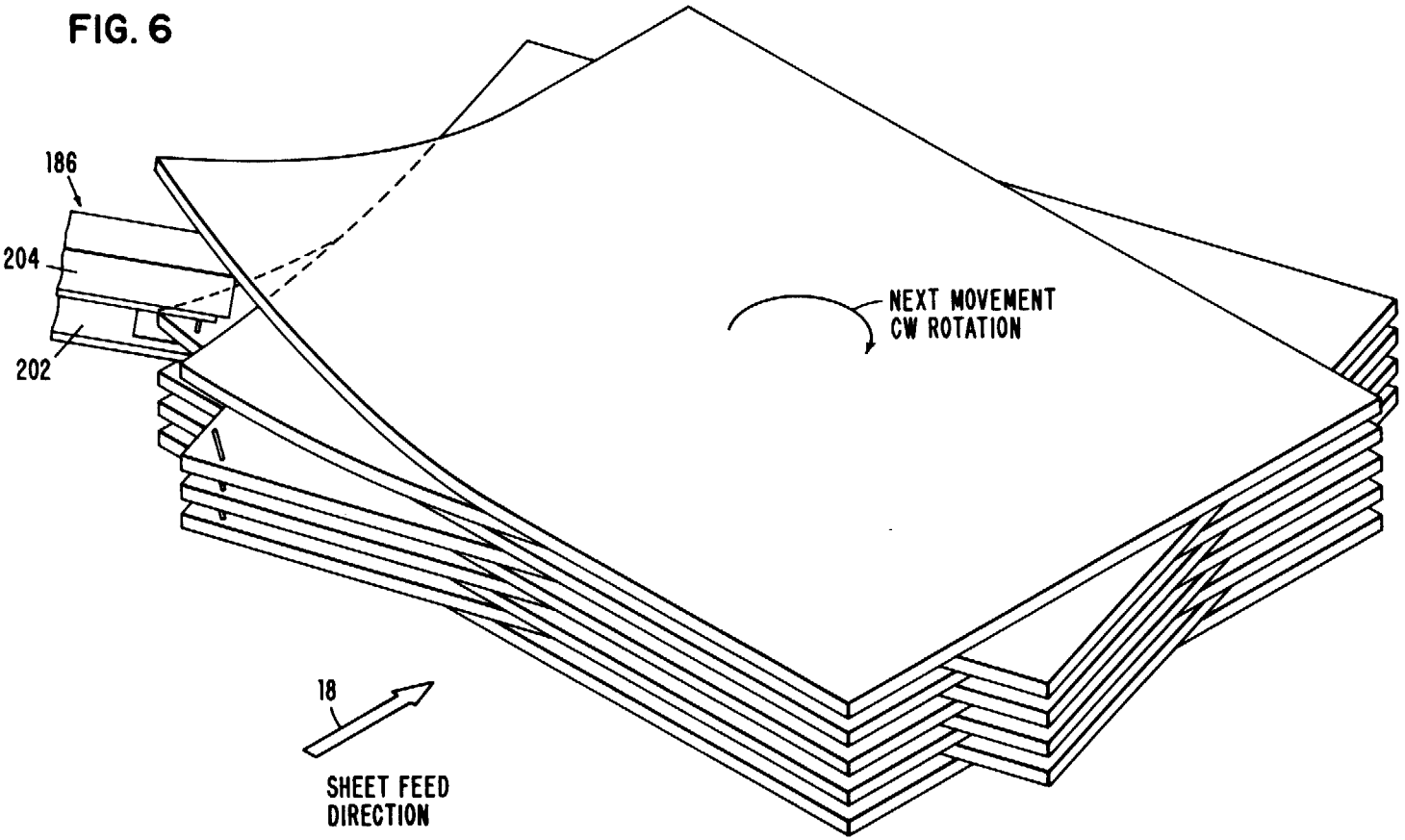
FIG. 6 is a partial perspective view illustrating the method of "offset stapling," according to the invention, and illustrating, by example, the processing of nine sets or jobs having six sheets each.

After the stapling of the first set or job, or concurrently therewith, first set catcher 190, via catcher solenoid S3 is moved to an out position as shown in FIG. 4. Clockwise rotation of oscillating sheet receiving bin 100 feeds the second (even) set into the stapling position N, and accordingly, the first set having been stapled is dropped into oscillating sheet receiving bin 100 (FIG. 6). This oscillatory operation continues until all sets or jobs have been stapled whereupon the logic control system stops the offset stapling operation and stapler device 186 is swung to the inoperative position by the action of staple position solenoid S4.

FIG. 6, previously mentioned, illustrates, by way of example, the stapling of nine sets comprising approximately six sheets each. As shown, sets or jobs one through seven have been stapled. Set or job eight is about to be stapled. The stack is being rotated in a clockwise direction, which will, as shown, move set or job eight into position for stapling i.e., in between stapler lower and upper jaws 202 and 204 of stapler device 186. When this event occurs, set or job nine will drop from the top of stapler device 186 and will be in a position to be stapled on the next counterclockwise rotation of the stack. As can be seen, when set eight is rotated after stapling, it will fall into the stack and set nine will be in a position for stapling.

FIG. 4 shows the actual movement during the offset stapling process of the corners of the odd and even sets or jobs. As shown, odd set or job travel is from position O to position N and the return direction. On the other hand, even set or job travel is from position M to position N and the return direction.

D. The Logic Control System

The operation of the apparatus, according to the invention, has been previously described in subsections A, B and C for the offset collation mode, offset sorting mode and offset stapling mode, respectively. This subsection, D, will outline the logic control system in circuit diagram form, timing diagram form and in the form of location tables for the various electrical and electromechanical elements according to the invention.

Figure 7A:
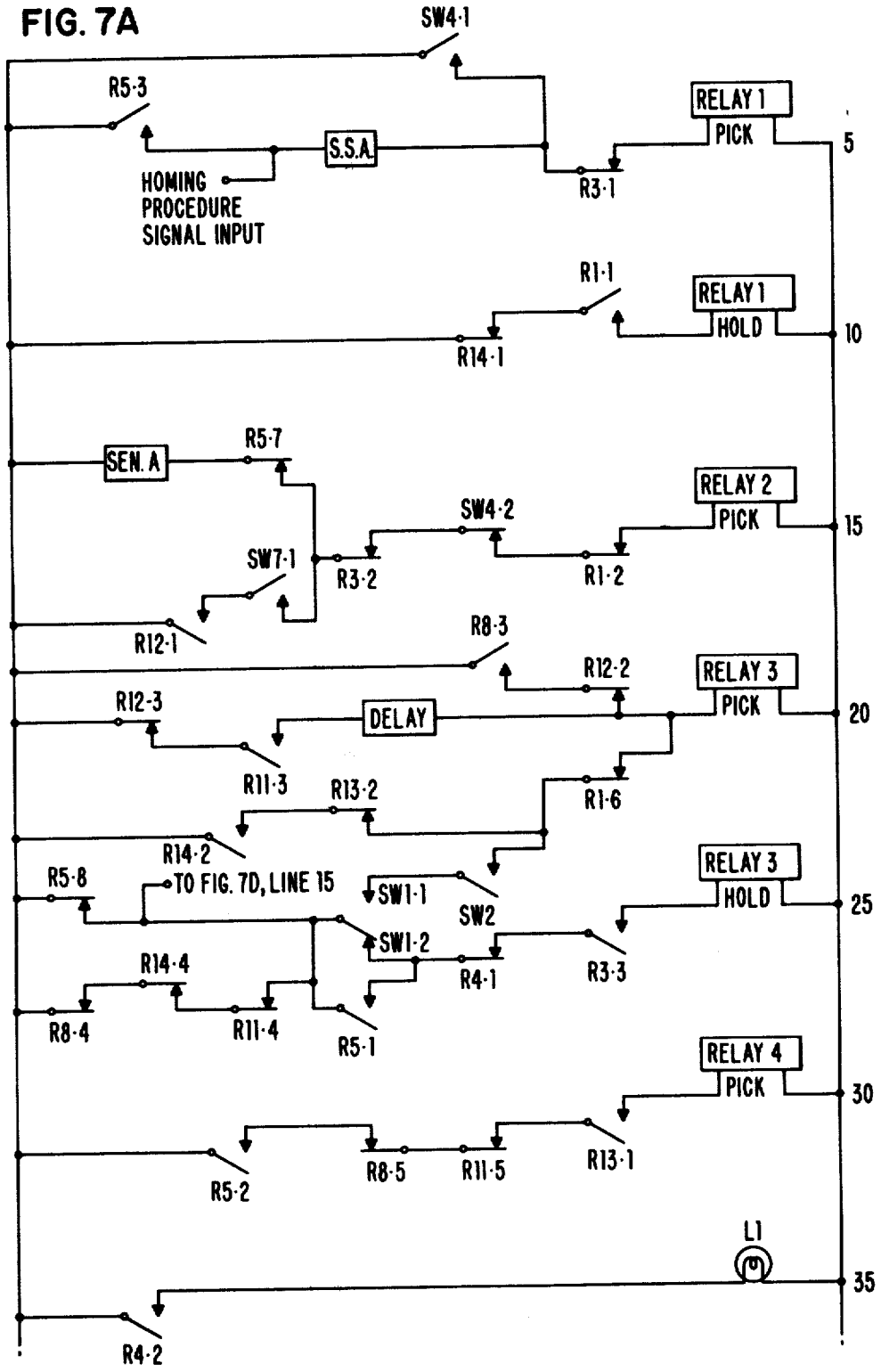
FIGS. 7A through 7D is a circuit diagram of the control logic system according to the invention.
Figure 7B:
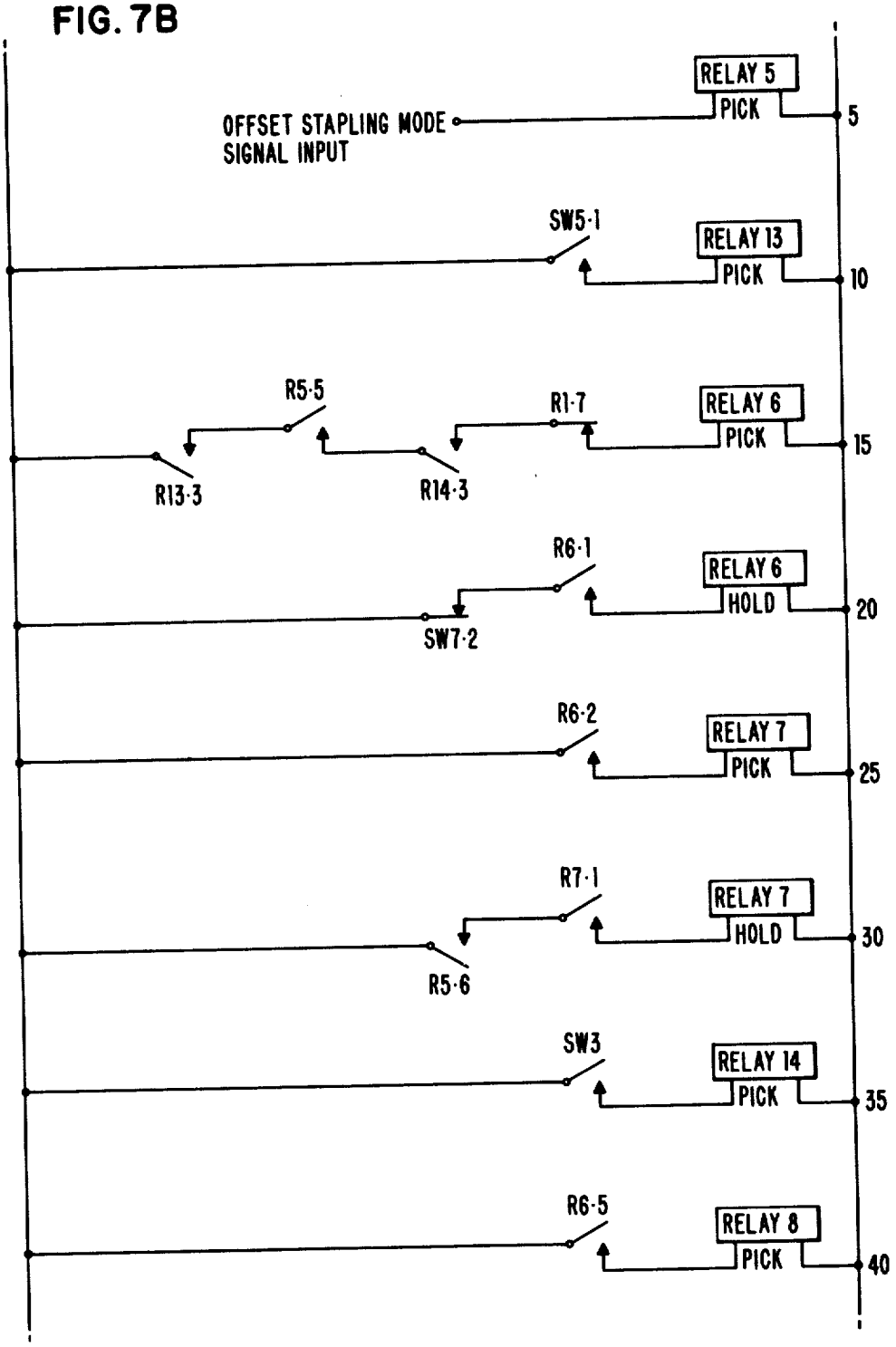
Figure 7C:
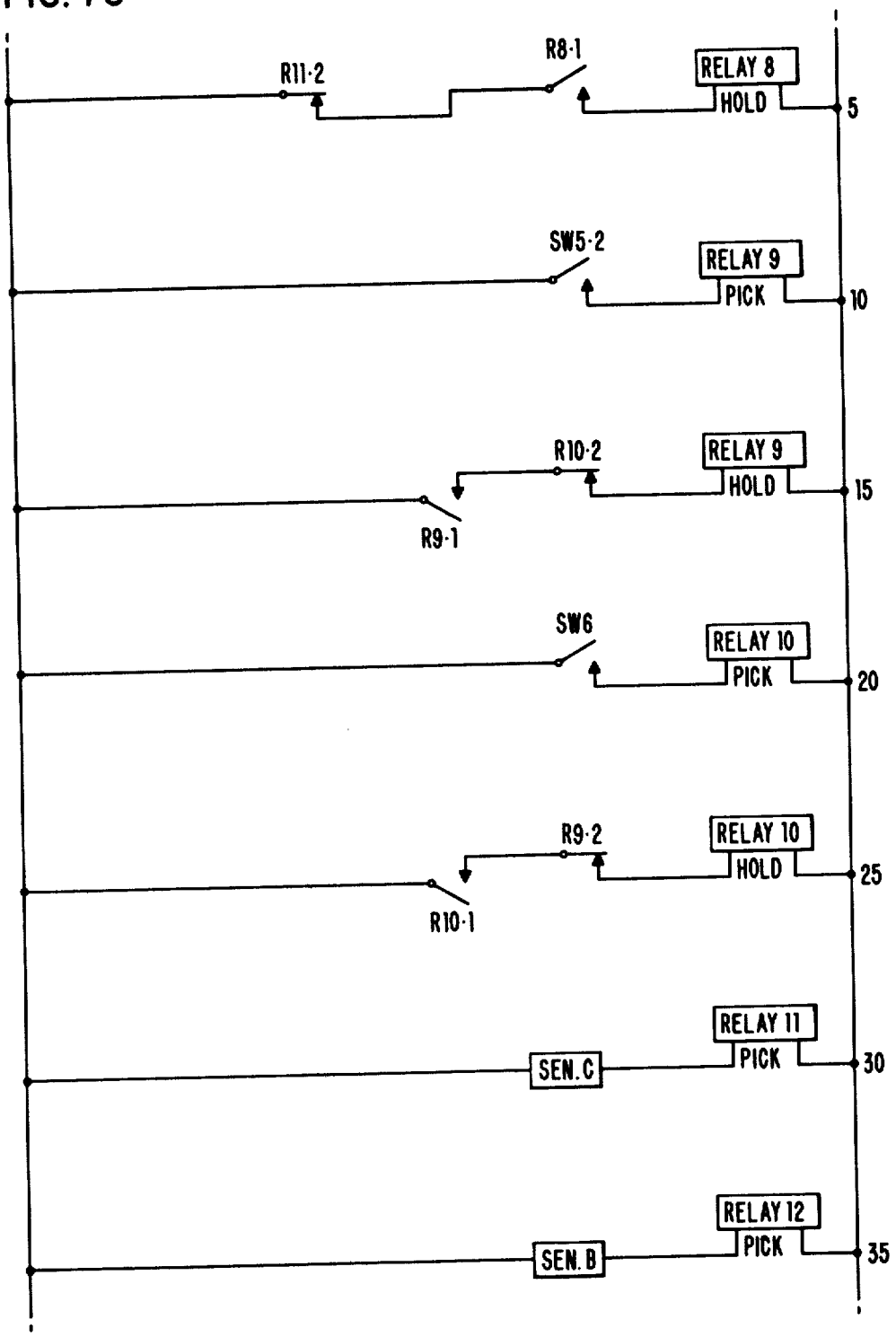
Figure 7D:
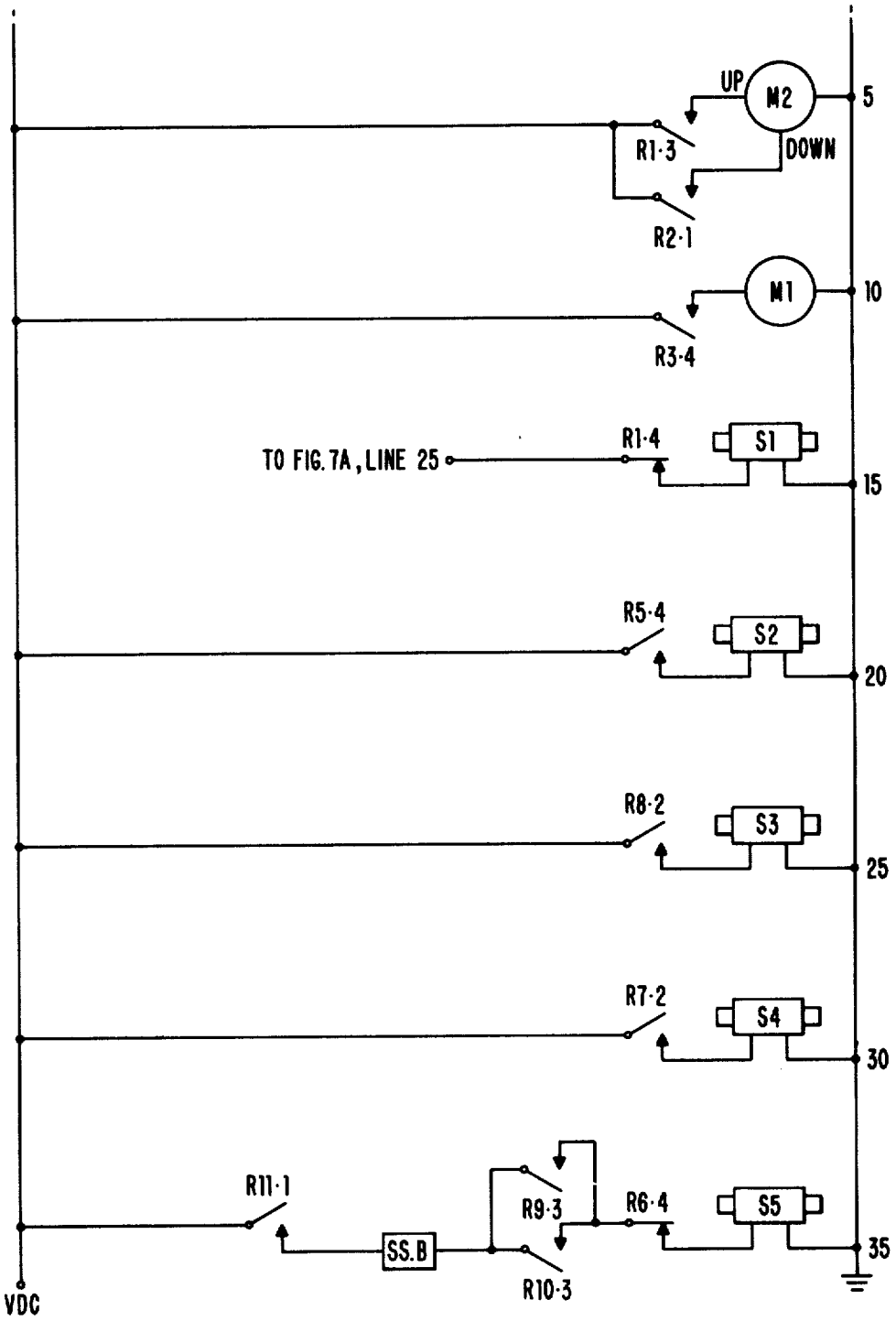
Figure 8:
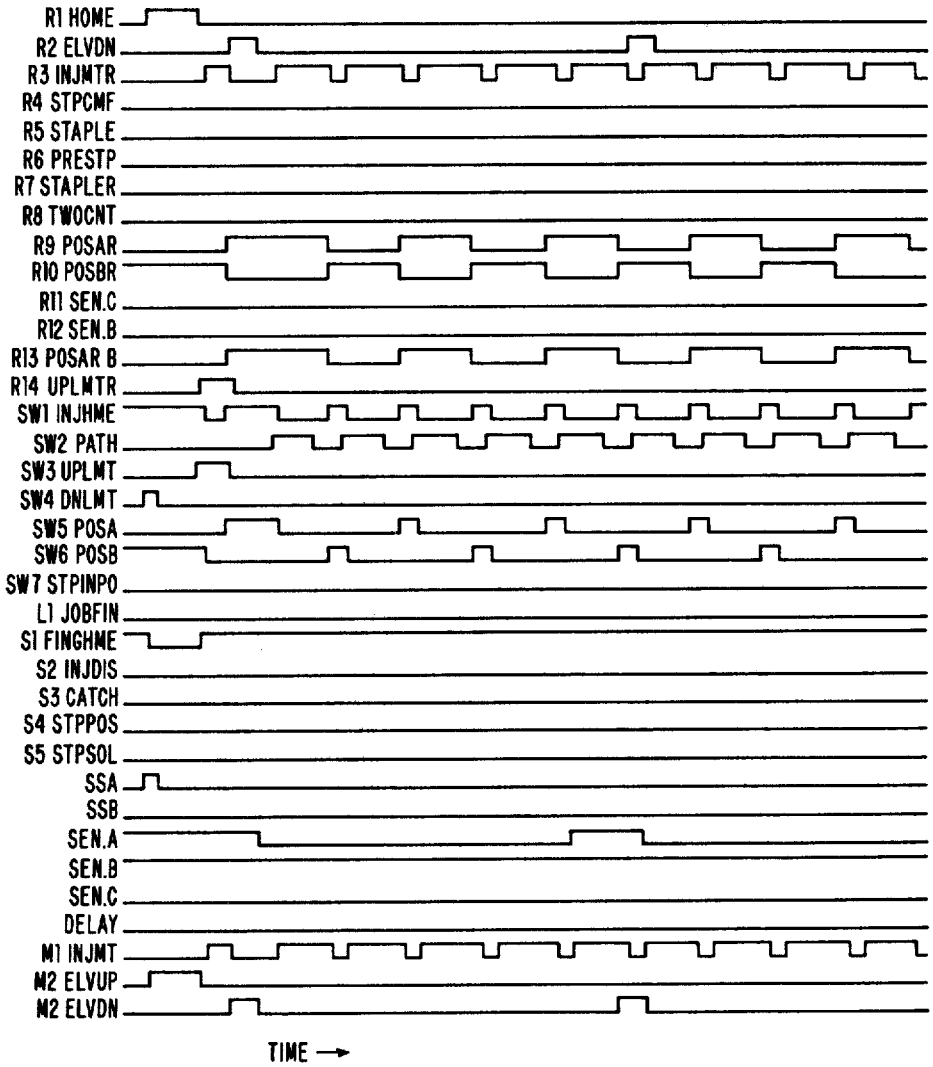
FIG. 8 is a timing diagram illustrating the sequential interrelationship of the various elements, according to the invention, during the offset collation mode of operation and during the processing of the sets or jobs illustrated in FIG. 6.
Figure 9:
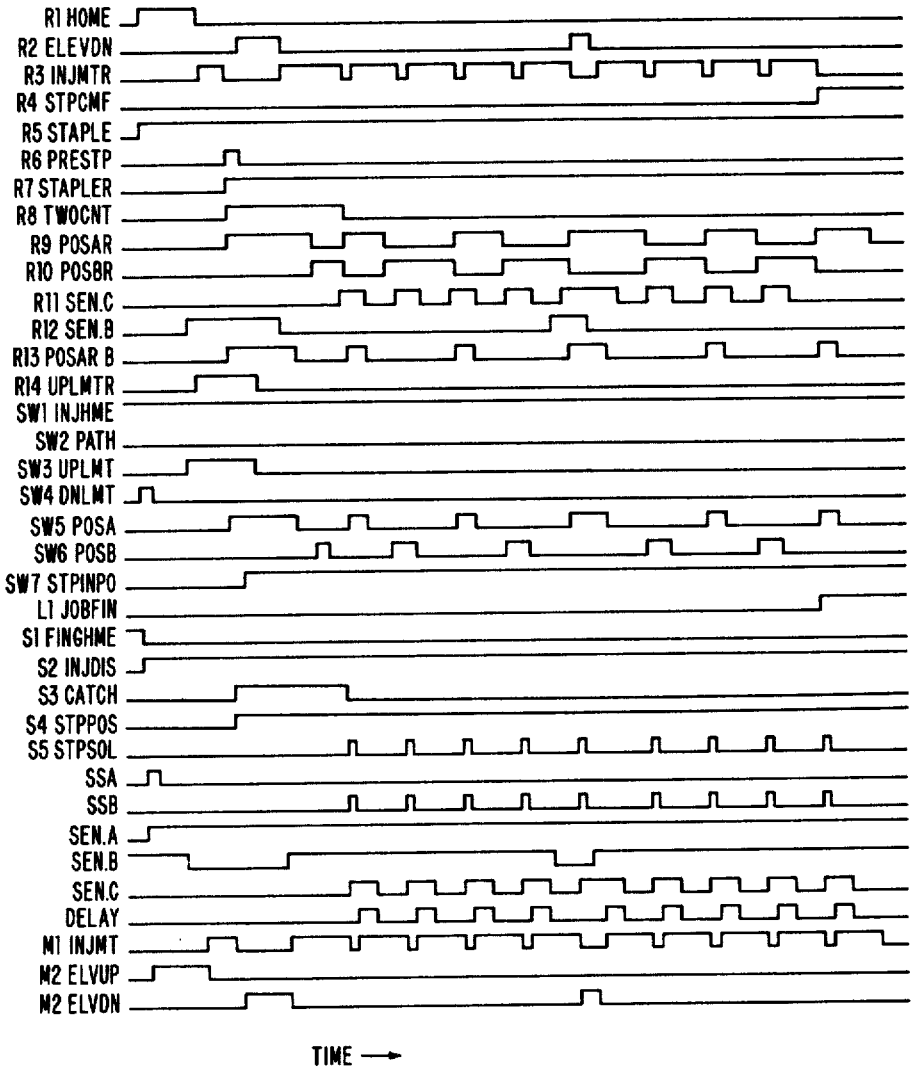
FIG. 9 is a timing diagram illustrating the sequential interrelationship of the various elements, according to the invention, during the offset stapling mode of operation and during the processing of the sets or jobs illustrated in FIG. 6.

FIGS. 7A through 7B show the logic control system wiring diagram, according to the invention. FIGS. 8 and 9 are timing diagrams for the offset collation mode and the offset stapling mode, respectively. The foregoing circuit diagrams and timing diagrams specifically show what has been described generally in the previous subsections.

To better refer to the logic control system, each wiring line in FIGS. 7A through 7D has a line location. For example, Table A, reproduced below, lists all of the relays in the circuit diagrams of FIGS. 7A through 7D and their functions. Table A also lists the location of the contacts and coils for the relays listed therein.

TABLE A

| RELAY | | CONTACTS AND COILS 1 | 2 | 3 | 4 | 5 | 6 | 7 | 8 | PICK | HOLD |
|---|---|---|---|---|---|---|---|---|---|---|---|
| R1 | HOME | 7A,10 | 7A,15 | 7D,5 | 7D,15 | | 7A,20 | 7B,15 | | 7A,5 | 7A,10 |
| R2 | ELVDN | 7D,5 | | | | | | | | 7A,15 | |
| R3 | INJMT | 7A,5 | 7A,15 | 7A,25 | 7D,10 | | | | | 7A,20 | 7A,25 |
| R4 | STPCMP | 7A,25 | 7A,35 | | | | | | | 7A,30 | |
| R5 | STAPLE | 7A,5 | 7A,30 | 7A,5 | 7D,20 | 7B,15 | 7B,30 | 7A,15 | 7A,25 | 7B,5 | |
| R6 | PRESTP | 7B,20 | 7B,25 | | 7D,35 | 7B,40 | | | | 7B,15 | 7B,20 |
| R7 | STAPLER | 7B,30 | 7D,30 | | | | | | | 7B,25 | 7B,30 |
| R8 | TWOCNT | 7C,5 | 7D,25 | 7A,20 | 7A,25 | 7A,30 | | | | 7B,40 | 7C,5 |
| R9 | POS A | 7C,15 | 7C,25 | 7D,35 | | | | | | 7C,10 | 7C,15 |
| R10 | POS B | 7C,25 | 7C,15 | 7D,35 | | | | | | 7C,20 | 7C,25 |
| R11 | SENSOR C | 7D,35 | 7C,5 | 7A,20 | 7A,25 | 7A,30 | | | | 7C,30 | |
| R12 | SENSOR B | 7A,15 | 7A,20 | 7A,20 | | | | | | 7C,35 | |
| R13 | POS ARB | 7A,30 | 7A,20 | 7B,15 | | | | | | 7B,10 | |
| R14 | UPLMT | 7A,10 | 7A,20 | 7B,15 | 7A,25 | | | | | 7B,35 | |

Table B reproduced hereinbelow lists all of the switches and their functions according to the invention. Table B also lists the switch contacts and their locations according to the circuit diagrams of FIGS. 7A through 7D.

TABLE B

| SWITCH | | CONTACTS 1 LOCATION | 2 (FIG.,LINE) |
|---|---|---|---|
| SW1 | INJECTOR HOME | 7A,25 | 7A,25 |
| SW2 | SHEET PATH | 7A,25 | |
| SW3 | BIN UP LIMIT | 7B,35 | |
| SW4 | BIN DOWN LIMIT | 7A,5 | 7A,15 |
| SW5 | BIN POSITION A | 7B,10 | 7C,10 |
| SW6 | BIN POSITION B | 7C,20 | |
| SW7 | STAPLER IN POSITION | 7A,15 | 7B,20 |

Table C reproduced hereinbelow lists other devices used in the circuit diagrams of FIGS. 7A through 7D. These devices include solenoids, single shot multivibrators, motors, etc. necessary for proper operation of the invention. Table C also lists the functions of the foregoing devices and their locations in FIGS. 7A through 7D.

TABLE C

| OTHER DEVICES | | LOCATION (FIG.,LINE) |
|---|---|---|
| S1 | FINGER HOME SOLENOID | 7D,15 |
| S2 | INJECTOR DISABLE SOLENOID | 7D,20 |
| S3 | CATCHER SOLENOID | 7D,25 |
| S4 | STAPLE POSITION ROTARY SOLENOID | 7D,30 |
| S5 | STAPLE SOLENOID | 7D,35 |
| SSA | SINGLE SHOT A | 7A,5 |
| SSB | SINGLE SHOT B | 7D,35 |
| M1 | INJECTOR MOTOR | 7D,10 |

TABLE C-continued

| OTHER DEVICES | | LOCATION (FIG.,LINE) |
|---|---|---|
| M2 | ELEVATOR MOTOR | 7D,5 |
| SENSOR A BIN DOWN | | 7A,15 |
| SENSOR B BIN DOWN | | 7C,35 |
| SENSOR C STAPLE SENSOR | | 7C,30 |
| BIN HOME (SIGNAL) | | 7A,5 |
| DELAY DEVICE | | 7A,20 |
| STAPLE MODE (SIGNAL) | | 7B,5 |
| JOB FINISHED LAMP L1 | | 7A,35 |

By use of Tables A through C, FIGS. 7A through 7D and the timing diagrams of FIGS. 8 and 9, a better understanding of the invention can be had.

The examples of offset collation and offset stapling, as discussed hereinbefore, assumed the offset collation of nine sets comprising six sheets each and the offset stapling of those nine sets. FIG. 8, which is a timing diagram for the offset collation mode, depicts, inter alia, the condition of five sheets of the nine sets having been collated. Hence, the timing diagram shows the relationship between the various elements of the invention slightly prior to and during the offset collation of the last nine sheets, i.e., the last sheet of each set. The foregoing information can be gathered from FIG. 8 by referring to the wave form for sheet path switch SW2. Also, from the timing diagram of FIG. 8, it is shown that initially, for the example shown, that bin down sensor SEN. A is actuated. As discussed earlier, this means that approximately 25 sheets or an increment thereof has been inserted in oscillating sheet receiving bin 100 (see FIG. 1). Now since a total of approximately 45 sheets have been inserted up to this point in time (5 sheets for the 9 sets), a partial homing procedure is taking place. Thus, as shown, bin down sensor SEN. A is made. Table C lists the location of bin down sensor SEN. A in FIG. 7A line 15.

Referring to FIG. 7A, line 15, the pick coil of elevator down relay R2 is actuated when bin down sensor SEN. A is actuated. When the pick coil of elevator down relay R2 is actuated, elevator motor M2 causes oscillating sheet receiving bin 100 (FIG. 1) to be lowered. Table C lists the location of this motor in FIG. 7D, line 5. Thus, referring to this location it is shown that for the previously mentioned condition that normally opened contact R2-1 of elevator down relay R2 closes allowing elevator motor M2 to operator as above described.

The bin home signal, input located in FIG. 7A, line 5, is a signal from the associated copier or like device (not shown), or a down counter type device as disclosed in the referenced application to Lamos. This signal indicates to the logic control system in the offset collation mode that the first sheet of the last set to be offset collated, has been inserted into oscillating sheet receiving bin 100 (see FIG. 1). When this signal is received, a complete homing procedure is commenced as previously described.

An example for the offset stapling mode will aid further in understanding the use of the tables, circuit diagrams and timing diagrams to ascertain specific operational aspects of the invention. From the previous discussion, before offset stapling can take place, injector disable solenoid S2 (Table C) has to be actuated to disengage right and left gripper/injector devices 36 and 38 (see FIG. 1). Accordingly, as listed in Table C, injector disable solenoid S2 is located in FIG. 7D, line 20. Thus, referring to FIG. 7D, line 20, in order for injector disable solenoid S2 to be energized, contact 4 of staple relay R5 has to be made. In order for this to happen, the pick coil of staple relay R5 has to be actuated. Referring then to Table A, the pick coil of staple relay R5 is located in FIG. 7B, line 5. Referring to FIG. 7B, line 5, the pick coil of staple relay R5 is made when a staple mode signal is received. For purposes of the invention, this signal can be provided from an associated copier or like machine (not shown), or a switch placed on the apparatus according to the invention.

There are several elements used in the operation of the invention that special mention should be made. For example, prestep relay R6 and two count relay R8 listed in Table A, are used together at the start of the offset stapling mode to ensure that the first set or job is properly in the jaws of stapler device 186 (see FIG. 4) before stapling takes place.

As listed in Table C, the delay device located in FIG. 7A, line 20, provides a 100 millisecond delay before the pick coil of injector motor relay R3 is actuated. This is to ensure that the set or job in the jaws of stapler device 186, aforementioned, has been stapled before oscillating sheet receiving bin 100 is rotated. For purposes of the invention, the delay device can be a delay relay, a single shot multi-vibrator or similar device. In addition, so that the apparatus, according to the invention, is properly synchronized in its operation, injector motor relay R3 listed in Table A, is a delay relay which takes at least 10 milliseconds to drop out to ensure that injector motor M1 stays energized during the switch of injector home switch SW1.

While the invention has been particularly described with reference to the preferred embodiments thereof, it will be understood by those skilled in the art that various changes in form and detail may be made therein without departing from the scope and spirit of the invention.

What is claimed is:

1. An offset collator wherein sheets are sequentially supplied in a sequence of the first sheets of each set numbering up to and corresponding to the number of sets to be offset collated and in turn, and in order, of additional sheets of each set numbering up to and corresponding to the number of sheets in a set, the improvement comprising:

reciprocating sheet transport means for engaging, transporting along a predetermined path and then releasing in said sequence, said sheets of sets to be offset collated;

sheet receiving means for receiving from said sheet transport means in said sequence said sheets of sets to be offset collated and for holding all the sheets of said sets, in contiguous, contacting relationship to one another forming a single, continuous stack, said sheet receiving means having means positionable in alternate positions so that said transport means transports each said sheet thereto, releasing said sheet therein while in an alternate one of said positions, for forming a single stack and for offsetting each said first sheet of each said set from adjacent first sheets in an alternate offset posture in said stack clearly demarcating each of said first sheets from adjacent first sheets; and means for separating said offset demarcated sheets of said single stack to allow transport injection therebetween of a second sheet, of each set to be offset collated, by said transport means and release thereof while said positionable means is in an alternate one of said positions so said second sheet is contiguous to said first sheet of its set, and transport and release of additional sheets, of each set to be offset collated, if required by the number of sheets in said sets, in the same alternate offset posture to each of the prior sheets of its sets; and means for controlling said sheet transport means and said sheet receiving means to coordinate said positioning, said transport, and said release such that said collated sets are concurrently formed in said sheet receiving means.

2. The offset collator according to claim 1 wherein said sheet receiving positionable means includes a movable sheet receiving bin for receiving, in said sequence, said sheets of sets to be offset collated, for moving between the release of each said transported sheet and the subsequent sheet, thereby causing said sheets to be collated therein in said alternate offset posture.

3. The offset collator according to claim 2 wherein said movable sheet receiving bin moves in a vertical plane for separating said offset demarcated sheets and in a horizontal plane for offsetting said sheets.

4. The offset collator according to claim 3 wherein said movable sheet receiving bin moves linearly in said vertical plane, and rotates in an oscillatory motion in said horizontal plane.

5. The offset collator according to claim 2 wherein said sheet receiving means further includes a sheet supporter/separator device for cooperating with said movable sheet receiving bin thereof for supporting said offset demarcated sheets of said single stack; and for separating said offset demarcated sheets of said single stack to allow transport therebetween of said second sheets, of said sets to be offset collated, by said transport means and released therebetween contiguous, and in the same offset posture, to each of the first sheets of its set, and if required by the number of sheets in said sets to be offset collated, additional sheets of each set contiguous and in the same offset posture to each of the prior sheets of its set.

6. The offset collator according to claim 1 wherein said sheet transport means includes a gripper/injector carrier; a drive means operatively connected thereto for driving said gripper/injector carrier in said reciprocating motion; right and left gripper/injector devices, one each operatively connected to an opposite side of said gripper/injector carrier and parallel to each other; rear and front carrier stops for operating said gripper/injector carrier to grip one said sequentially supplied sheet to be offset collated when said gripper/injector carrier is proximated to said rear carrier stops; said gripper/injector carrier thereafter transporting said sheet in a forward direction into said sheet receiving means, to release said sheet into said sheet receiving station when said gripper/injector carrier is proximate to said front carrier stops; and thereafter said gripper/injector carrier reciprocates in a reverse direction away from said sheet receiving station until, again, it is proximate to said rear carrier stops, thereby completing a cycle of said reciprocating motion.

7. An offset collator/offset stapler apparatus wherein sheets to be collated into a plurality of sets of sheets are supplied thereto in a sequence of the first sheets of each set, numbering up to and corresponding to the number of said sets to be collated, and the subsequent feeding, in turn, and in order, of additional sheets of each set numbering up to and corresponding to the number of sheets in a set, whereupon, after offset collation, the offset collated sets are offset stapled to form finished sets, said apparatus comprising:

reciprocating sheet transport means for transporting along a predetermined path and then releasing in said sequence, said supplied sheets of sets to be offset collated and offset stapled;

sheet receiving means for receiving, in said sequence, said transported sheets of sets to be offset collated and for holding all the sheets of said sets in contiguous relationship to one another forming a single, continuous stack, said sheet receiving means including means for receiving and forming a single stack of each said first sheet of each set to be offset collated and offset stapled; means for moving horizontally with respect to said transport means to offset each said released first sheet from adjacent first sheets in an alternate offset posture in said single stack clearly demarcating each of said first sheets from adjacent first sheets; means for separating said offset demarcated sheets of said single stack for receiving therebetween a second sheet of each set to be offset collated and offset stapled contiguous to each of said first sheets of its set, and transport of additional sheets of each set to be offset collated and offset stapled, if required by the number of sheets in said sets, contiguous and in the same alternate offset posture to each of the prior sheets of its sets;

offset stapling means rotatably disposed adjacent to one side of said sheet receiving means for offset stapling said offset collated sets, said offset stapling means including means cooperating with said sheet receiving means for moving from an inoperative position to an operative position; and means for sequentially stapling said offset sets of said single stack while maintained in their alternate offset posture to each of the other sets of the stack before, during and after offset stapling thereof; and means for controlling said sheet transport means, said sheet receiving means and said offset stapling means to maintain said offset stapling means in said inoperative position during the forming of said offset collated sets, to move said offset stapling means into said operative position after the forming of said offset collated sets in said sheet receiving means, and to disassociate said sheet transport means from said sheet receiving means whereby said offset collated sets are stapled.

8. An offset stapler apparatus for corner stapling offset sets in a single stack of collated sets or jobs comprising:

movable sheet receiving bin means for receiving collated sets or sorted jobs disposed therein in an alternate offset posture to form said offset sets in said stack each said set having an alternate offset portion thereof and for maintaining said collated sets or said sorted jobs in said alternate offset posture;

stapler separation means for initially engaging said alternate offset portion of a bottom one of said alternate offset sets and thereby supporting said stack, releasing the bottommost set, and for cooperating with said movable sheet receiving bin means for sequentially engaging said alternate offset portion of successive ones of said alternate offset sets or jobs and thereby supporting the remainder of said stack while successively releasing ones of said sets or jobs; and offset stapling means disposed adjacent to one side of said movable sheet receiving bin means for offset stapling said collated sets or said sorted jobs, said movable sheet receiving bin cooperating with said offset stapling means and said stapler separation means to move each of said released collated sets or said released sorted jobs into said stapling means, to corner staple said set or job and to remove said set or job from said offset stapling means, whereby said collated sets or sorted jobs of said offset stack are corner stapled in sequence, all of the collated sets or the sorted jobs being maintained in their alternate offset posture to each of the other sets or jobs of said offset stack before, during and after offset stapling thereof.

9. The offset stapler according to claim 8 wherein said movable sheet receiving bin is movable in the vertical and horizontal planes.

10. The offset stapler according to claim 9 wherein said movable sheet receiving bin is movable in a linear up or down motion in said vertical plane, and is movable in an oscillatory motion in said horizontal plane causing thereby, said released collated sets or said released sorted jobs of said offset stack to be properly positioned in said offset stapling station for sequential corner stapling thereof.

11. Apparatus for offset collating sequentially supplied sheets, comprising:

movable receiver means for translating between each of at least two different positions and for receiving sheets while in said positions to form clearly demarcated offset sheets, said receiving means holding all the collated sheets in contiguous contacting relationship to one another, forming a single, continuous stack;

insertion means for sequentially engaging each of said sequentially supplied sheets and for sequentially inserting said sheets in said receiver means, forming a single stack;

means to control said receiver means and said insertion means for positioning each said sheet in one of said different positions than that for the immediately preceding sheet, said sheets being offset thereby; and separation means at said receiver means for engaging said inserted offset sheets and separating differently offset adjacent sheets of said stack to allow said insertion means to insert a further sequentially supplied sheet between said separated sheets.

12. The apparatus of claim 11 for collating said supplied sheets into a plurality of sets of sheets, wherein said control means for controlling the operation of said receiver means, insertion means and separation means inserts at said different positions of said receiver means a number of said sequentially supplied sheets equal to the number of said plurality of sets of sheets, and to repetitively separate said previously inserted differently offset adjacent sheets and insert the next subsequently supplied sheet between said separated sheets at the position of said receiver means where said inserted sheet is identically offset to one of said adjacent sheets, whereby said sheets both having the identical offset and being contiguous comprise a set.

13. The apparatus of claim 12 wherein:

said control means is additionally arranged to control said separation means and said insertion means to process sequentially through said sheets from one end to the other for inserting in each such processing pass a number of said subsequently supplied sheets equal to the number of said plurality of sets of sheets.

14. The apparatus of claim 13 wherein:

said receiver means is additionally arranged to move in a rotary fashion in a common plane so as to expose as said different offset, corners of said sheets.

15. The apparatus of claim 14 additionally comprising:

stapling means for separating at one of said corners each of said sets of sheets upon completion of said offset collation and for stapling said sets at said separated corners.

16. The apparatus of claim 15 wherein:

said stapling means additionally comprises a separating bar; and said control means is additionally arranged to operate said movable receiver means to cause said differently offset corners to successively engage said separating bar.

* * * * *